US012655073B2

(12) United States Patent
Yamamoto et al.

(10) Patent No.: US 12,655,073 B2
(45) Date of Patent: Jun. 16, 2026

(54) MULTI-PART MIXED ENERGETIC MATERIALS AND EPOXY BINDERS

(71) Applicant: The United States of America, as represented by the Secretary of the Navy, Crane, IN (US)

(72) Inventors: Christina Yamamoto, Bloomington, IN (US); Anthony P. Shaw, Madison, NJ (US)

( * ) Notice: Subject to any disclaimer, the term of this patent is extended or adjusted under 35 U.S.C. 154(b) by 194 days.

(21) Appl. No.: 18/224,755

(22) Filed: Jul. 21, 2023

(65) Prior Publication Data

US 2023/0365476 A1 Nov. 16, 2023

Related U.S. Application Data

(63) Continuation of application No. 16/290,200, filed on Mar. 1, 2019, now Pat. No. 11,746,068.

(60) Provisional application No. 62/636,932, filed on Mar. 1, 2018.

(51) Int. Cl.
*C06B 21/00* (2006.01)

(52) U.S. Cl.
CPC ..... *C06B 21/0008* (2013.01)

(58) Field of Classification Search
None
See application file for complete search history.

(56) References Cited

U.S. PATENT DOCUMENTS 3,089,796 A * 5/1963 De Maris ..... C06B 45/10 149/19.6
3,577,289 A * 5/1971 Morrell ..... C06B 27/00 149/19.2
2009/0320977 A1* 12/2009 Shortridge ..... C06B 33/04 264/3.1

* cited by examiner

*Primary Examiner* — Aileen B Felton
(74) *Attorney, Agent, or Firm* — Naval Surface Warfare Center, Crane Division; Patrick B. Law

(57) ABSTRACT

The present invention relates to methods and processes to prepare pre-mixed compositions that can be combined to form pyrotechnic compositions in mixed multiple parts. In exemplary embodiments, a binder curing agent ingredient is premixed with pyrotechnic fuels and can also include other pyrotechnic additives and processing aides. Other binder ingredients such as a binder resin can be premixed with the pyrotechnic oxidizers and can also include other pyrotechnic additives and processing aides. The resulting mixtures are not explosive and are much safer to handle and easier to store for extended shelf-life over a final pyrotechnic composition. Further, the pre-mixed mixtures can be stored in bulk until needed and rapidly combined to achieve the final pyrotechnic composition.

7 Claims, 3 Drawing Sheets

MULTI-PART MIXED ENERGETIC MATERIALS AND EPOXY BINDERS

CROSS-REFERENCE TO RELATED APPLICATIONS

The present application is a continuation of U.S. patent application Ser. No. 16/290,200, filed Mar. 1, 2019, entitled "THREE PART MIXING PROCESS FOR ENERGETIC MATERIALS AND EPOXY BINDER," which claims the benefit of and priority to U.S. Provisional Patent Application Ser. No. 62/636,932, filed Mar. 1, 2018, entitled "THREE PART MIXING PROCESS FOR ENERGETIC MATERIALS AND EPOXY BINDER," the disclosures of which are expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200433US03) is assigned to the United States Government and is available for licensing for commercial purposes. Licensing and technical inquiries may be directed to the Technology Transfer Office, Naval Surface Warfare Center Crane, email: Crane_T2@navy.mil.

FIELD

The present invention relates to a mixing process of a multi-part binder-based pyrotechnic composition using two pre-mixed compositions.

BACKGROUND OF THE DISCLOSURE

The present invention relates to a mixing process of a multi-part binder-based pyrotechnic composition for safe pre-mixing and storage of less hazardous, partially processed multi-part binder based pyrotechnics.

Typically, a number of pyrotechnic ingredients (e.g., fuel, oxidizer, binder, additives) will be subsequently added to a mixing bowl until a homogeneous mixture is obtained. The binder is often composed of a resin and a curing agent and sometimes one or more modifying ingredients. In many pyrotechnic mixing processes, the binder ingredients are pre-blended and added to the mixer as a single component. In other cases, the binder ingredients can be added individually but often early in the process, to give the binder time to coat all of the other pyrotechnic ingredients or to coat the most sensitive material first. Most often, the binder is premixed and added to the fuel first to coat it and make it less sensitive then the other ingredients are added one at a time each being coated. If the energetic mix was blended beforehand without the binder, it could be hazardous and problematic to store. To this point, once the resin and curing agent portions of the binder come into contact, the overall process becomes time-limited because the cross-linking polymeric chemistry has a finite time before it cures and hardens. Furthermore, the curing process will ideally take place in the items form factor to provide mechanical strength to the end-item. Therefore, the mixed pyrotechnic composition has a limited "pot life" where all subsequent processing steps (e.g., granulation, extrusion, multi-step pressing) must be completed in a relatively short time frame; sometimes as short as a few hours. As such, if one does not process a batch of multi-part binder based pyrotechnic into its form factor within that timeframe, one may have to dispose of the remaining composition at significant cost or risk making suspect-quality end-items.

According to an illustrative embodiment of the present disclosure, mixing allows for safe pre-mixing and storage of less hazardous, partially processed multi-part binder based pyrotechnics. Two pre-mixtures can be combined on an as-needed basis and the final processing step can occur significantly faster than a conventional mixing process since the binder ingredients have already been dispersed in the previous pre-mixing steps. As such, when the two parts of the pre-mixed materials are combined, the final composition can be rapidly generated and post-processed on an as-needed basis.

According to a further illustrative embodiment of the present disclosure, one of the binder ingredients (e.g., resin or curing agent) is premixed with the pyrotechnic fuels and can also include other pyrotechnic additives and processing aides. The resulting mixtures are not explosive and are therefore easier to store and much safer to handle. The other binder ingredients (e.g., resin or curing agent) can be premixed with the pyrotechnic oxidizers and can also include other pyrotechnic additives and processing aides. The resulting mixtures are not explosive and are therefore easier to store and much safer to handle. These pre-mixed mixtures can be stored in bulk until needed and rapidly combined to achieve final composition.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION

The embodiments of the invention described herein are not intended to be exhaustive or to limit the invention to precise forms disclosed. Rather, the embodiments selected for description have been chosen to enable one skilled in the art to practice the invention.

Figure 1:
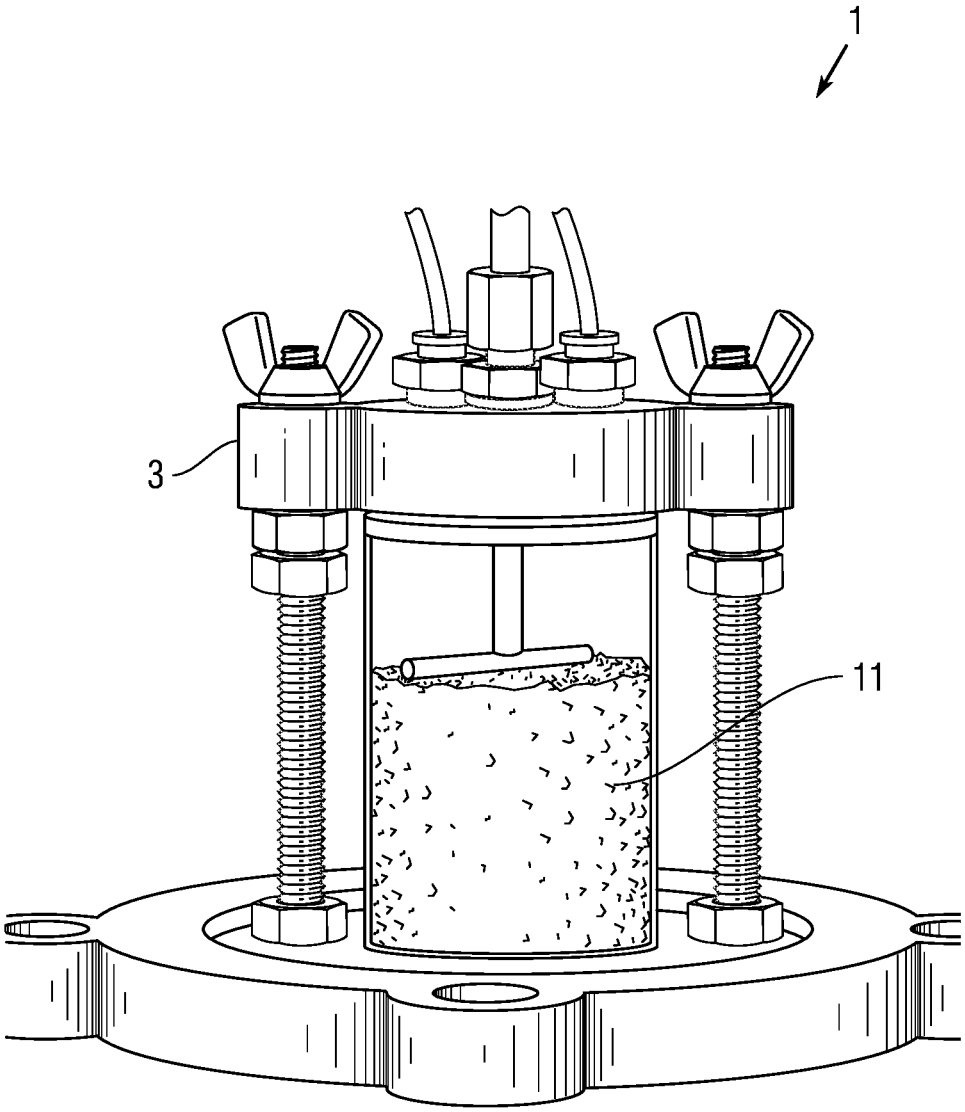
FIG. 1 shows an exemplary apparatus for creating an exemplary first pre-mixed composition.

FIG. 1 shows an exemplary apparatus 1 for creating an exemplary first pre-mixed composition 11. Fuel (e.g., magnesium, aluminum, sucrose) can added to a first container, then a binder curing agent (e.g., Versamid 140) and an optional process aide (e.g., acetone) can be added into a second container and mixed thoroughly until the binder curing agent is dissolved to create a first mixture, then the first mixture can be poured on top of the fuel and placed in a mixer 3 (e.g., a mix-muller mixer, a Resonant Acoustic Mixer (RAM), etc.). In at least some embodiments, processing aides can be preferred when the combination of fuel and curing agents do not mix well. A processing aide (e.g., acetone, polyethylene glycol) can prevent clumping and help mix the fuel and curing agents evenly, and can be beneficial for certain types of mixers (e.g., RAM). Highly viscous binder curing agents (e.g., Versamid 140) mix better with metallic, higher density, low hydroscosity materials, and high surface area, so highly viscous binder curing agents are well suited to be mixed with metallic fuels (e.g., magnesium, aluminum, copper, etc.). The first mixture and fuel can be mixed for various durations (e.g., 2 minutes) and mixing speeds (e.g., 65 G of acceleration), and, in at least some embodiments, under a vacuum setting (e.g., 22 inches of vacuum) dependent on mixing location (e.g., elevation). The resulting mixture is a first pre-mixed composition which can be safely stored for longer than the shelf life of a pyrotechnic composition.

Figure 2:
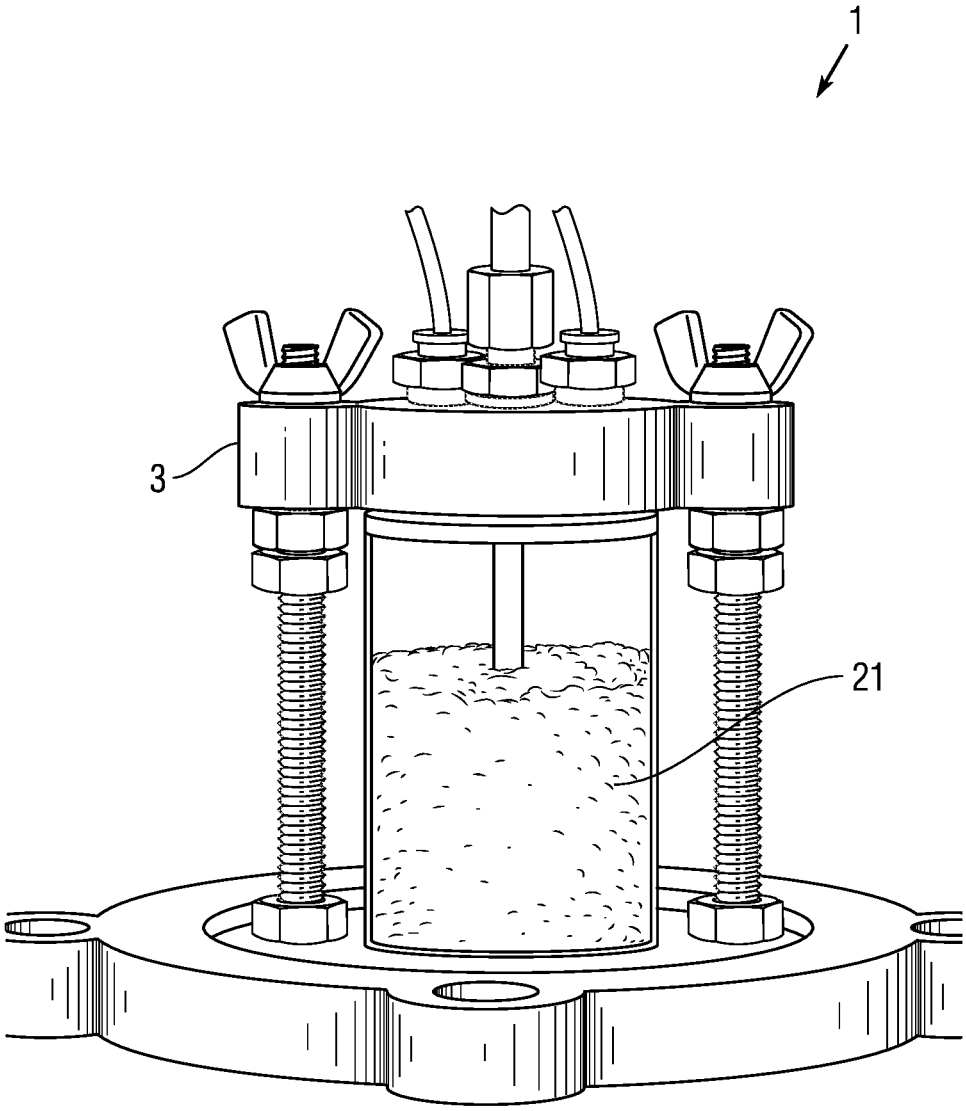
FIG. 2 shows an exemplary apparatus for creating an exemplary second pre-mixed composition.

FIG. 2 shows an exemplary apparatus 1 for creating an exemplary second pre-mixed composition 21. An oxidizer (e.g., sodium nitrate, iron oxide, potassium chlorate, etc.) can be added to a third container, a binder resin (e.g., Araldite® 507, which is a known Bisphenol-A (BPA) liquid epoxy resin modified with a diluent) can be added on top, and then a processing aide (e.g., acetone, polyethylene glycol) can added on top to create a second mixture. The second mixture can be placed in a mixer 3 and can be mixed for various durations (e.g., 1 minute) and mixing speeds (e.g., at 95 G's of acceleration, then reduced to 65 G of acceleration), and, in at least some embodiments, under a vacuum setting (e.g., 22 inches of vacuum). The resulting mixture is a second pre-mixed composition 21 which can be safely stored for longer than the shelf life of a pyrotechnic composition. Other additives (e.g., asphaltum, carbon black, etc.) can be added to the second mixture.

In at least some embodiments, different combinations of fuel, oxidizer, binder curing agent, and binder resin can be used. The fuel and oxidizer should always be kept in separate pre-mixed compositions. Binder curing agents and binder resins should be kept in separate pre-mixed compositions to prevent premature hardening of the compositions.

Additives generally have a tendency to act as either a fuel or an oxidizer, and it is preferred to add additives to the mixture matching their tendencies (e.g., oxidizer additives added to the oxidizer) to minimize potential for energetic reactions. For example, graphite tends to act as a fuel, and can be included as an additive in the first pre-mixed composition. By keeping fuel and oxidizer separate as well as curing agent and resin separate, there are two primary permutations of pre-mixed compositions: (1) fuel+curing agent and oxidizer+resin; and (2) fuel+resin and oxidizer+curing agent. Viscous curing agents (e.g., Versamid 140) can be effectively mixed with coarse oxidizers.

The proportion of fuel to oxidizer will be set based on the desired pyrotechnic composition. The amount of binder ingredients required will be based on the selected fuel and oxidizer. Exemplary methods can use predetermined proportions of each ingredient typically used to prepare selected pyrotechnic combinations without varying the amount of binder required to evenly mix with other ingredients (e.g., fuel, oxidizer). By coating the fuel with binder ingredients, the fuel becomes far less likely to oxidize during storage, even when exposed to air. As such, a pre-mixed composition including fuel can be stored for long periods of time without needing to vacuum seal the pre-mixed composition. Mixing compatibility between binder ingredients and either fuel or oxidizer will depend on the type of mixer selected. For example, RAM mixers are more likely to cause clumping when adding a viscous curing agent to a fuel, whereas mix-muller mixers will be comparatively easier.

Figure 3:
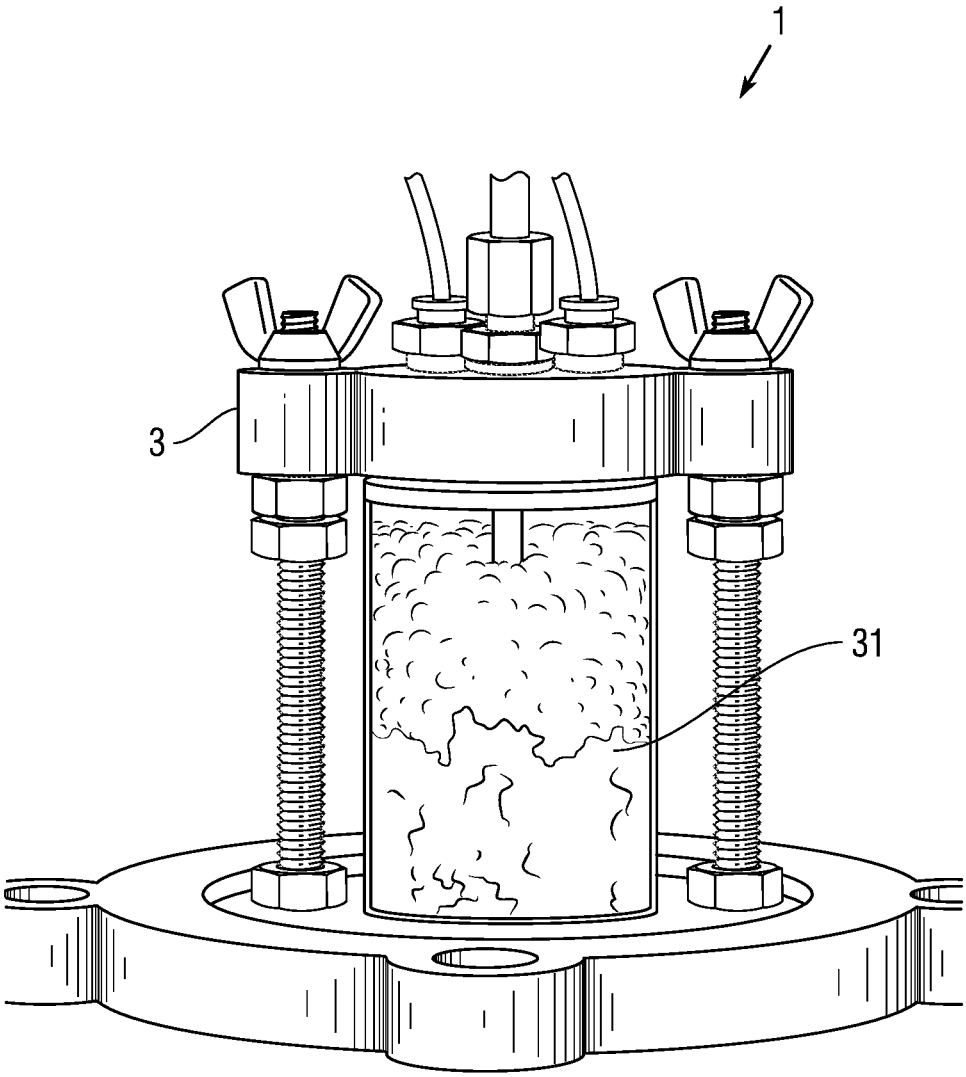
FIG. 3 shows an exemplary apparatus for creating a pyrotechnic composition by combining a first and second pre-mixed composition.

FIG. 3 shows an exemplary apparatus 1 for creating a pyrotechnic composition 31 by combining a first and second pre-mixed composition. In most pyrotechnic compositions, the ratio of first to second pre-mixed composition can be very important. To ensure that the proper amounts of pre-mixed compositions are added, any processing aides used in either composition can be evaporated from the compositions prior to storing the compositions or before mixing the compositions together. In some embodiments, if the amount of processing aide (e.g., percent by weight) is known in both pre-mixed compositions, then the compositions can be mixed without removing (e.g., evaporating) the processing aide. The first and second pre-mixed compositions can then be combined and mixed with mixer 3 to create a pyrotechnic composition.

This method can be utilized using a variety of mixers such as bowl, mix-muller, twin-screw extrusion or resonant acoustic mixing. The concept of separate mixing and holding can potentially be used for many different applications, the illumination flare just happened to be the flare of choice however, this method is adaptable to colored flares, IR flares, and any other pyrotechnic with a multi-part binder system Although the invention has been described in detail with reference to certain preferred embodiments, variations and modifications exist within the spirit and scope of the invention as described and defined in the following claims.

The invention claimed is:

1. A multi-part processed pyrotechnic composition comprising:

a first pre-mixed composition of the multi-part processed pyrotechnic composition comprising at least one fuel and a binder curing agent, wherein the first pre-mixed composition is prepared by mixing the at least one fuel and the binder curing agent at a first predetermined mixing setting using a resonant acoustic mixer (RAM); and a second pre-mixed composition of the multi-part processed pyrotechnic composition comprising at least one oxidizer and a binder resin comprising a Bisphenol-A liquid epoxy resin modified with a diluent, wherein the second pre-mixed composition is prepared by mixing the at least one oxidizer and the binder resin at a second predetermined mixing setting using the RAM;

wherein the first pre-mixed composition and the second pre-mixed composition each comprise a non-explosive, partially processed multi-part binder based pyrotechnic that is separately storable with a longer shelf-life than a prepared pyrotechnic composition formed by mixing the first and the second pre-mixed compositions.

2. The composition of claim 1, further comprising:

the prepared pyrotechnic composition prepared by mixing the first and the second pre-mixed compositions at a third predetermined mixing setting.

3. The composition of claim 1, wherein the first predetermined mixing setting includes a first predetermined mixing speed and a first vacuum pressure over a first predetermined time period.

4. The composition of claim 1, wherein the second predetermined mixing setting includes at least a second predetermined mixing speed and a second vacuum pressure over a second predetermined time period.

5. The composition of claim 1, wherein preparing the first pre-mixed composition further comprises mixing the at least one fuel and the binder curing agent using a processing aide.

6. The composition of claim 5, wherein the processing aide comprises acetone or polyethylene glycol.

7. The composition of claim 5, further comprising:

preparing the first pre-mixed composition by:

mixing the processing aide with the binder curing agent to create a first mixture; and combining the first mixture with the at least one fuel at the first predetermined mixing setting.

* * * * *